US010525330B1

(12) United States Patent
Ridges et al.

(10) Patent No.: US 10,525,330 B1
(45) Date of Patent: Jan. 7, 2020

(54) PLAYING CARD READER

(71) Applicant: MASQUE PUBLISHING, INC., Lone Tree, CO (US)

(72) Inventors: John C. Ridges, Castle Rock, CO (US); Steven R. Setlik, Denver, CO (US); James M. Wisler, Lone Tree, CO (US)

(73) Assignee: MASQUE PUBLISHING, INC., Lone Tree, CO (US)

( * ) Notice: Subject to any disclaimer, the term of this patent is extended or adjusted under 35 U.S.C. 154(b) by 0 days.

(21) Appl. No.: 15/955,011

(22) Filed: Apr. 17, 2018

Related U.S. Application Data

(60) Provisional application No. 62/502,875, filed on May 8, 2017.

(51) Int. Cl.

| | |
|---|---|
| ***A63F 1/18*** | (2006.01) |
| ***A63F 1/06*** | (2006.01) |
| ***G06K 9/00*** | (2006.01) |
| ***A63F 9/24*** | (2006.01) |
| *A63F 1/00* | (2006.01) |
| *A63F 1/12* | (2006.01) |

(Continued)

(52) U.S. Cl.
CPC ..... *A63F 1/18* (2013.01); *A63F 1/067* (2013.01); *A63F 9/24* (2013.01); *G06K 9/00442* (2013.01); *A63F 1/12* (2013.01); *A63F 1/14* (2013.01); *A63F 3/00157* (2013.01); *A63F 2001/003* (2013.01); *A63F 2003/00164* (2013.01); *A63F 2009/2425* (2013.01); *A63F 2009/2454* (2013.01)

(58) Field of Classification Search
CPC .. A63F 2001/003; A63F 1/14; A63F 3/00157; A63F 2003/00164; A63F 1/12; A63F 2009/2425; A63F 2009/2454; A63F 1/067; A63F 1/18
USPC ..... 273/292, 309, 148 R, 149 R; 463/12, 46, 463/47
See application file for complete search history.

(56) References Cited

U.S. PATENT DOCUMENTS 5,632,483 A * 5/1997 Garczynski ..... A63F 1/06 273/148 R
5,669,816 A 9/1997 Garczynski et al.
5,681,039 A 10/1997 Miller
(Continued)

OTHER PUBLICATIONS

The Wizard of Odds, Down Under Blackjack (2016 version) YouTube video, Dec. 21, 2016. https://www.youtube.com/watch?v=oJiyMbuGliy4 (Year: 2016).*

*Primary Examiner* — Benjamin Layno
(74) *Attorney, Agent, or Firm* — David F. Zinger

(57) ABSTRACT

A card reading apparatus is provided for playing a casino table game identified as Down Under Blackjack™. The apparatus includes a camera assembly, a computer, a housing assembly and a plurality of color indicators. The computer receives pixel-based image data from the camera assembly. This data is obtained from the dealer's down card during play of the game. The computer processes this data to output information related to a predetermined set of playing cards associated with the down card. Such output activates one of the color indicators corresponding to that particular predetermined set. The information associated with the activated indicator can be used by players in playing the Down Under Blackjack™ game. Use of the apparatus enables the game to be played using conventional playing cards.

19 Claims, 10 Drawing Sheets

(51) Int. Cl.

| | |
|---|---|
| *A63F 3/00* | (2006.01) |
| *A63F 1/14* | (2006.01) |

(56) References Cited

U.S. PATENT DOCUMENTS

| | | | | |
|---|---|---|---|---|
| 5,722,893 | A | 3/1998 | Hill et al. | |
| 5,772,505 | A | 6/1998 | Garczynski et al. | |
| 6,403,908 | B2 | 6/2002 | Stardust et al. | |
| 8,150,158 | B2 | 4/2012 | Downs, III | |
| 2009/0314188 | A1* | 12/2009 | Toyama ..... | A63F 1/12<br>108/50.11 |

* cited by examiner

PLAYING CARD READER

CROSS REFERENCE TO RELATED APPLICATION

This application claims the benefit of, including priority to, U.S. Provisional Application Ser. No. 62/502,875, filed May 8, 2017, the entire content of which is incorporated herein by this reference.

FIELD OF THE INVENTION

The present invention relates to obtaining information from a playing card and using that information while playing a casino table game.

BACKGROUND OF THE INVENTION

Blackjack continues to be a highly popular table game played in substantial numbers of casinos. Its popularity has spawned variants of the game, together with accompanying features or side bets that can be played while playing conventional Blackjack. One variant is the Spanish 21® card game, which is described in U.S. Pat. No. 5,615,888. An example of an accompanying feature to a Blackjack game is the feature or game identified as Match The Dealer®, which is described in U.S. Pat. No. 5,806,846.

A recent variant of traditional Blackjack is the casino table game identified by Down Under Blackjack™. Part of the play of Down Under Blackjack™ involves providing the player(s) with information about the dealer's down (unexposed or down facing) card. In one embodiment, certain indicia, colors or other markings are provided on the card backs of playing cards having conventional card fronts. The particular markings depend on the rank of the particular playing card. For cards having a rank in the range of 2-5 (small card), a first predetermined marking is provided on each card. For cards having a rank in the range of 6-9 (medium card), a second predetermined marking is provided on each card. For cards having a rank in the range of 10-ace (large card), a third predetermined marking is provided on each card. After the initial two cards are dealt to the dealer, including the dealer's down card, the dealer determines, using the marking on the down card, whether that down card is a designated small, medium or large card. Depending on that determination, the dealer places at least the dealer's down card in one of three predetermined areas or sections provided on the casino table game layout. Each of these predetermined areas corresponds to one of a small, medium or large card. Once placed, each player has information regarding the rank of the dealer's down card. For example, if the down card is placed in the predetermined area corresponding to a small card, each player has the information that the dealer's down card is one of a 2, 3, 4, or 5. Each player can use such information in conjunction with his/her decision to continue to play the game and trying to beat the dealer's ultimate hand. Because the Down Under Blackjack™ game includes this additional information that favors the player, some conventional Blackjack game rules and payouts change to take into account that advantage.

As understood from the foregoing description of the Down Under Blackjack™ game, changes to conventional playing cards are required in order to provide additional information to the players about the dealer's down card. It would, however, be worthwhile or beneficial to be able to provide the same information to the players while using conventional, unmodified playing cards for the Down Under Blackjack™ game.

The use of a card reading device to obtain playing card information is well-known. One such device is described in one or more embodiments disclosed in U.S. Pat. No. 5,681,039 issued Oct. 28, 1997 to Miller and entitled "Card Reader for Blackjack Table." Technologies that utilize computer components for determining the rank of a conventional playing card have also been devised. In that regard, see U.S. Pat. No. 8,150,158 issued Apr. 3, 2012 to Downs III, entitled "Unique Sensing System and Apparatus for Reading Playing Cards" and one or more of the numerous patents noted and/or cited therein. Although such prior devices or systems may be appropriate for their noted applications, it would be advantageous to provide a playing card reading apparatus that functions effectively and efficiently with the Down Under Blackjack™ game, while the installation and use of such an apparatus are facilitated and straightforward.

SUMMARY OF THE INVENTION

In accordance with the present invention, a card reading apparatus for obtaining information from a card front of a conventional playing card and using that information is provided. The apparatus has particular utility in obtaining and using information related to the rank of the playing card, which information is used in playing the casino table game identified as Down Under Blackjack™.

The card reading apparatus includes a housing assembly that can contain, or otherwise hold, a camera assembly and a computer, which can include at least one processor. The camera assembly is operatively associated with the computer whereby image pixel-related information can be output by the camera assembly for use by the computer. The computer can also have memory for storing data or other information and/or for storing software used by the apparatus. The housing assembly is connected to, or otherwise held in a desired or fixed position using, a casino table having a game layout for use in playing a casino table game, such as the one identified as Down Under Blackjack™. The game layout can be placed over a conventional foam layer of the casino table. The game layout for this game can include three sections that are used in designating the class or group associated with the playing card after it is read by the apparatus. The housing assembly can be defined as including a card receiver subassembly including a card receiver body having an upper surface. At least portions of the card receiver subassembly can be located above the game layout, and with the card receiver body upper surface being at least substantially even or coplanar with the game layout. The housing assembly can be further defined as including first and second housing sections having at least substantial portions that can be disposed below the game layout. These two housing sections, when joined together, can contain the camera assembly and the computer. The card receiver subassembly can include a cover having a slot for receiving at least desired portions of at least one playing card (e.g. the dealer's down card) so that such portions of the playing card front can be read, i.e., card identifying information can be obtained.

The camera assembly is immovably supported within the two housing sections such that its camera lens is aligned with the desired portions of the at least one playing card, when it is located, or being located, in the slot of the card receiver subassembly. The apparatus also includes a plurality of indicators that are held or supported by the housing assembly. In one embodiment, there are three indicators, which can be LEDs (light emitting diodes) with different color bulbs or light output components. At least some portions of each LED are located in the cover of the housing assembly so that, when lit, that LED can be seen by the dealer and each player as having been activated.

The housing assembly can also include elongated fasteners, together with fastening nuts. Each of these fasteners has a head and each terminates in end portions. Each head is joined to the bottom of the card receiver body using a snap-in connection. Each fastener extends such that its end portions can be received by a bracket subassembly that is used in interconnecting the two housing sections. With each fastener properly positioned using the bracket subassembly, the fastening nuts can be placed on the fastener end portions and finger tightened to secure the housing sections to the casino table. Such connection hardware also facilitates any disconnection of the two housing sections, including the components contained therein, from the casino table.

Two types of shims can also be provided as part of the housing assembly. These shims can be advantageous, when use thereof is needed, in desirably positioning the upper surface of the card receiver body relative to the game layout. These shims can include at least one reader shim or at least one foam shim. Having a plurality of each of the reader shim and the foam shim enables such shims to have different thicknesses and thereby provide fine or precise adjustments in order to achieve such desirable positioning. Typically, a foam shim is not needed when a reader shim is used. And, a reader shim is not needed when a foam shim is used.

The one or more reader shims, when needed, are utilized in raising the card reading apparatus so that the upper surface of the card receiver body is in a desired position relative to the game layout. That is, during installation, a determination may be made that the upper surface will be unsuitably below the foam layer, as well as the game layout that is to be positioned over the foam layer. Such location may be due, for example, to a foam layer that has a relatively large thickness so that the apparatus needs to be raised until the upper surface is even or co-planar with the game layout. Such raising/positioning can be accomplished using one or more reader shims, with the number thereof and the amount of thickness of each depending on the distance that the apparatus should be raised to be in a proper position relative to the game layout.

The one or more foam shims, when needed, are utilized in raising the conventional foam layer so that the upper surface of the card receiver subassembly is in a desired position relative to the game layout. That is, during installation, a determination may be made that the upper surface will be unacceptably above the foam layer and, likewise, the game layout that is to be positioned over the foam layer. Such location may be due, for example, to a foam layer that has a relatively small thickness, thereby necessitating that the foam layer be raised until proper positioning will occur between the upper surface and the game layout. Such raising/positioning can be accomplished using one or more foam shims, with the number thereof and the amount of thickness of each depending on the distance that the foam layer should be raised so that the card reading apparatus can be in a proper position relative to the game layout.

With regard to utilizing the apparatus during play of the Down Under Blackjack™ game, the apparatus is mounted to a casino table using a previously formed suitable opening or hole in the table top or supporting surface. As in conventional Blackjack, two cards are initially dealt to the player(s) at the table and to the dealer. One of the dealer's cards is an up (exposed) card and the other card is a down (unexposed) card. The dealer moves at least the dealer's down card into the slot of the card receiver subassembly. As the down card is moved towards its final position in the slot, the camera assembly can be outputting pixel-based card-identifying information to the computer. The outputting thereof occurs without waiting for the down card to be in any particular position in the slot. That is to say, the outputting can start before the card is fully or desirably positioned in the slot and can continue to occur until the card is so desirably positioned by a card dealer. The pixel-based information is obtained from desired, such as card corner, portions of the down card. Such information represents the visual information that is seen or found on those portions of the down card front.

The obtained pixel-based information that is continuously output by the camera assembly is received by the computer, which is electrically connected thereto or otherwise in communication with the camera assembly. Using the camera assembly information, software executed by the computer ascertains whether at least one black or dark color/non-blank pixel is present with such received information. Such pixel-based information is indicative of down card identifying information (card symbol or rank) being present. If such one or more pixels are present, known, commercially available software that has been modified or simplified for the present invention is used to define boundaries associated with the received information or card portions image data. Such boundaries define or limit the card image data that will be analyzed by computer executable first software related to determining the symbol or rank of the down card being read. Such analyzing includes forming an array based on pixel-based information found within the defined boundaries. The contents of the array are then used by a neural network of the first software to ascertain the rank or value of the down card. The output of the neural network related to the rank of the down card is used in providing information to second software, which is stored in memory in communication with the processor of the computer. The second software is used in classifying the value or rank of the down card being read by the apparatus. A down card can be classified or characterized as small, medium or large, according to the rules of the Down Under Blackjack™ game. The output of the neural network associated with the first software relates to the value or rank of the down card. That output can be used in providing information to the second software for its use in determining the class or group of the three classes with which it is associated. The second software basically compares the input it receives with stored information or data related to ranks or values having associated class or group information.

The second software output related to identifying or classifying the particular down card is used to activate the LED corresponding to the class or group with which the down card is associated. For example, if the down card has a "5" rank, the second software is used to classify it as a member of the set of playing cards labeled or classified as small. The second software output causes the LED to be lit that corresponds to the small class. The dealer and the players can see the particular one of three LEDs that was lit corresponding to the small set of playing cards. Based on that observation, the dealer moves at least the dealer's down card to one of the predetermined sections on the layout that corresponds or is identified as being used to receive the dealer's down card when it is classified as being part of the small set. With this information about the dealer's down card provided to the player(s), each can make his/her decisions related to game play using that information.

Based on the foregoing, the present invention has particular utility in conjunction with playing the casino table game identified as Down Under Blackjack™. The card reading apparatus eliminates any requirement for special or unconventional playing cards that would be used to play this game if the cards had to be marked with predetermined indicia (markings having desired shapes and/or colors). Accordingly, casinos do not have to purchase and inventory such different cards. Additionally, the computer of the apparatus not only identifies the value of the dealer's down card but also classifies the identified card using a plurality of three predetermined sets of playing cards. In so providing those two functions, the computer can generate two separate items of information. First, it can produce first information related to the value or rank of the down card. Second, it can output second information related to the predetermined set associated with that down card or to which that down card belongs. Importantly, the first information is not the information that is available or can be used by the players or dealer in playing this casino table game. Rather, the second information is the information available for use by the player in accordance with the Down Under Blackjack™ game playing rules. The housing assembly of the card reading apparatus can also include one or more reader or foam shims that can provide desired apparatus height alignment with the game layout. Such housing assembly can also include casino table connection hardware that facilitates connection/removal of substantial housing assembly portions relative to a casino table, including joined sections that contain the camera assembly and computer.

Additional advantages of the present invention are readily apparent, particularly when taken together with following descriptions including the accompanying drawings.

DETAILED DESCRIPTION

Figure 1:
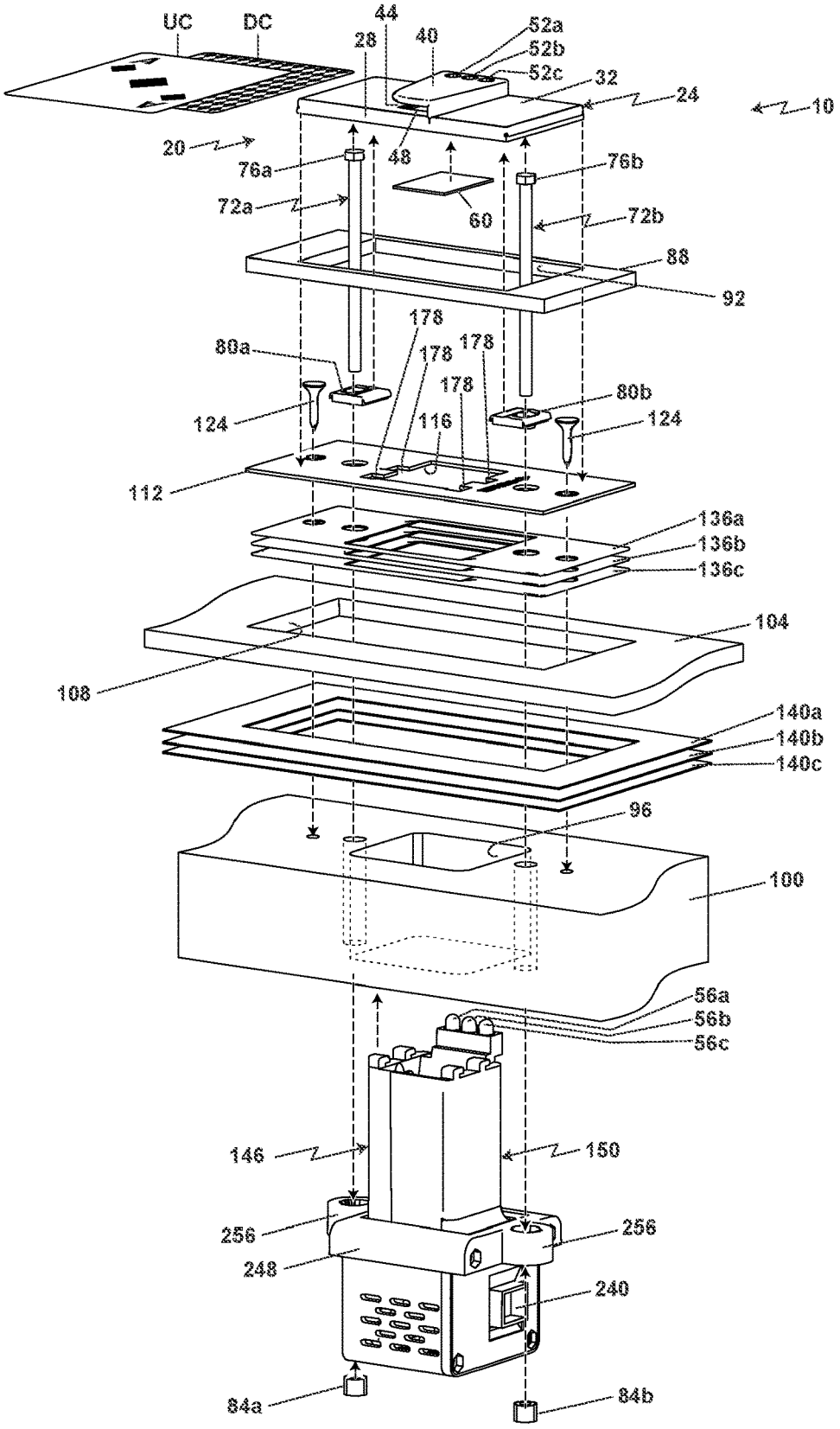
FIG. 1 is an exploded view illustrating parts or components of the card reading apparatus of the present invention including its housing assembly.

With reference initially to FIG. 1, an apparatus 10 for use in playing a casino table game identified as Down Under Blackjack™ is illustrated. The apparatus 10 can be characterized as a playing card reader that provides an output related to information about the dealer's down card that can be used by players in playing the game.

Figure 3:
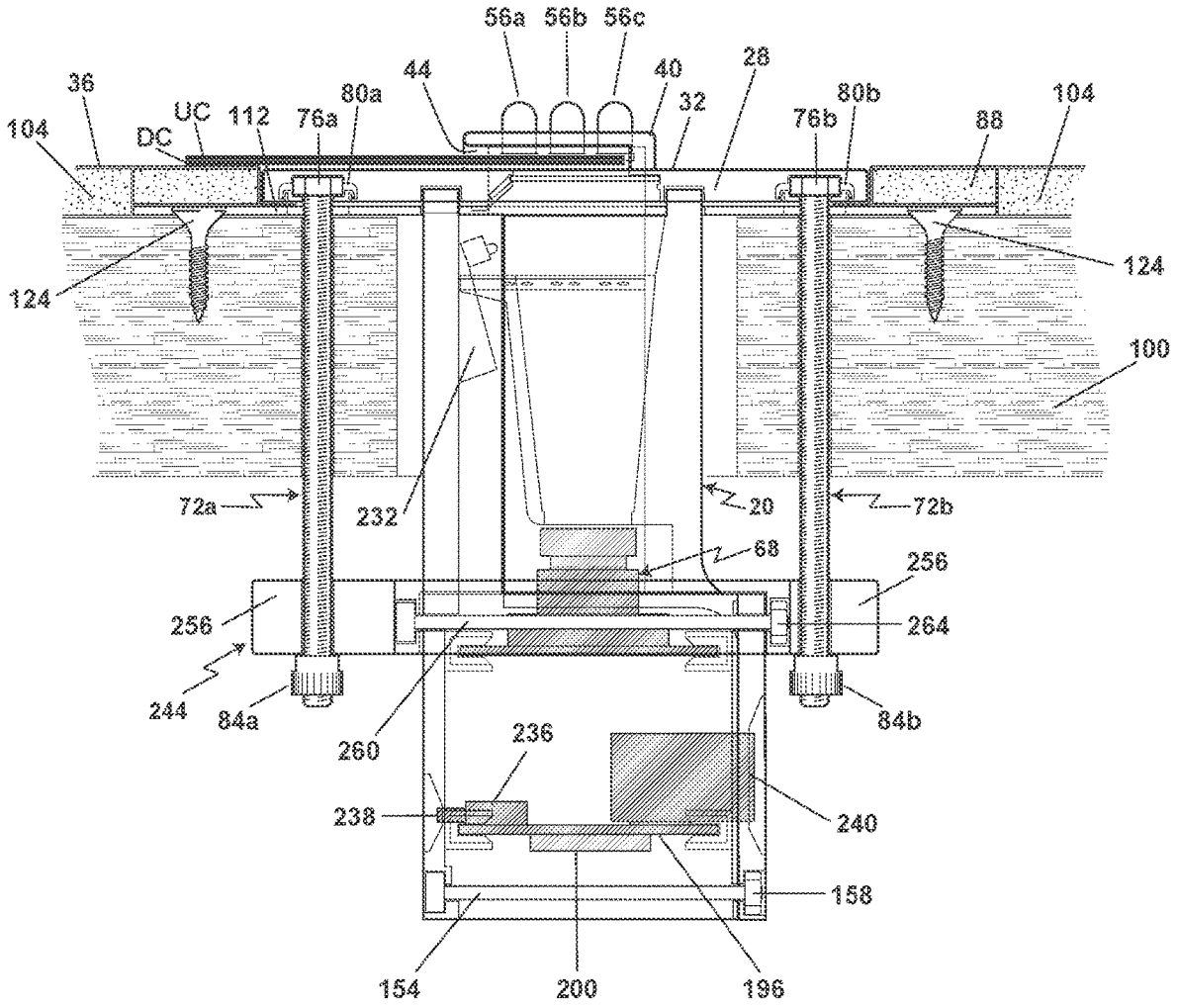
FIG. 3 is a sectional view illustrating the apparatus joined to a casino table without using reader shims or foam shims.

The apparatus 10 includes a housing assembly 20, which holds or otherwise supports other parts or components of the apparatus 10. The housing assembly 20 includes a card receiver subassembly 24, which includes a card receiver body 28 having an upper surface 32. The upper surface 32 can be even with, or at least substantially aligned with, a casino game layout or table covering felt material 36, as depicted in FIG. 3. The card receiver subassembly 24 has a cover 40 that is configured and positioned to define a slot 44. The slot 44 is useful in receiving portions of a down card (DC) that can be moved or positioned into the slot 44 (see also FIG. 3) by a casino table game dealer during play of the Down Under Blackjack™ game. In one embodiment, portions of the down card can be positioned in the slot 44 beneath an up card (UC) (see also FIG. 3). At least portions of the defined slot 44 overlie an opening 48, which is provided in the bottom of the card receiver body 28. The cover 40 has a number of apertures 52, preferably three apertures 52*a*, 52*b*, 52*c*. Each of the apertures 52 can receive one of color indicators 56. Correspondingly, there are preferably three color indicators 56*a*, 56*b*, 56*c*, with at least portions thereof being able to be positioned in the three apertures 52*a*, 52*b*, 52*c*. As will be described in more detail below, each of the color indicators 56 is useful in providing information about the dealer's down card.

The card receiver subassembly 24 also includes a transparent lens protector 60 that can be located within the card receiver body 28 and held thereby by any suitable means, such as by a snap in or friction fit. The lens protector 60 can be made of glass or acrylic and can prevent unwanted dust or other particles from passing through the opening 48 and possibly contacting and/or obstructing a lens 64 of a camera assembly 68, with the camera assembly 68 including lens 64 being seen in FIG. 2.

Continuing to refer to FIG. 1, together with FIG. 3, the housing assembly further includes two elongated fasteners 72*a*, 72*b*, with the fasteners 72*a*, 72*b* having respective heads 76*a*, 76*b*. The fasteners 72*a*, 72*b* can be connected to the card receiver body 28 using snap-ins 80*a*, 80*b* that hold the heads 76*a*, 76*b*, respectively, by means of friction fits or snap in characteristics associated with the snap-ins 80*a*, 80*b*. The snap-ins 80*a*, 80*b* can be fixed to the card receiver body 28 using a suitable bonding material or adhesive. The ends of the fasteners 72*a*, 72*b*, which are opposite their respective heads 76*a*, 76*b*, can receive fastening nuts 84*a*, 84*b*, respectively. The combinations of the fasteners 72*a*, 72*b* and the fastening nuts 84*a*, 84*b* are advantageous in facilitating the connection of the apparatus 10 to a casino table and any removal from the table, as will be described in more detail hereinbelow.

The housing assembly 20 can include a foam member 88 that can surround the card receiver body 28. The foam member 88 has an opening 92 having portions that can be aligned in a vertical direction with the card receiving body opening 48 and with the lens protector 60. The foam member 88 can be useful in locating the apparatus 10 relative to a cut-out 96 formed in the wood structure 100 of a casino table during installation when the apparatus 10 is joined to a casino table. The foam member 88 can be made of a material similar to, or having physical characteristics like, the foam layer 104 of FIG. 1 that is conventionally utilized between the casino table wood structure 100 and the game layout 36, as shown in FIG. 3. The foam layer 104 also has opening 108 formed therein for receiving portions of the housing assembly 20. The foam layer opening 108 has at least portions vertically aligned with card receiver body opening 48, foam member opening 92, and casino table cut-out 96.

The housing assembly 20 can also include a mount plate 112 having an opening 116 that can be aligned with the card receiver body opening 48 and foam member opening 92, as well as the foam layer opening 108 and the wood structure cut-out 96. The mount plate 112 can be useful in mounting or positioning the housing assembly 20 relative to the cut-out 96. The mount plate 112 can be joined to the card receiver body 28 of the card receiver subassembly 24 using the fasteners 72*a*, 72*b*. The mount plate 112 can be connected to the casino table wood structure 100 of the conventional casino table using a number of connectors 124, such as wood screws.

Figure 4:
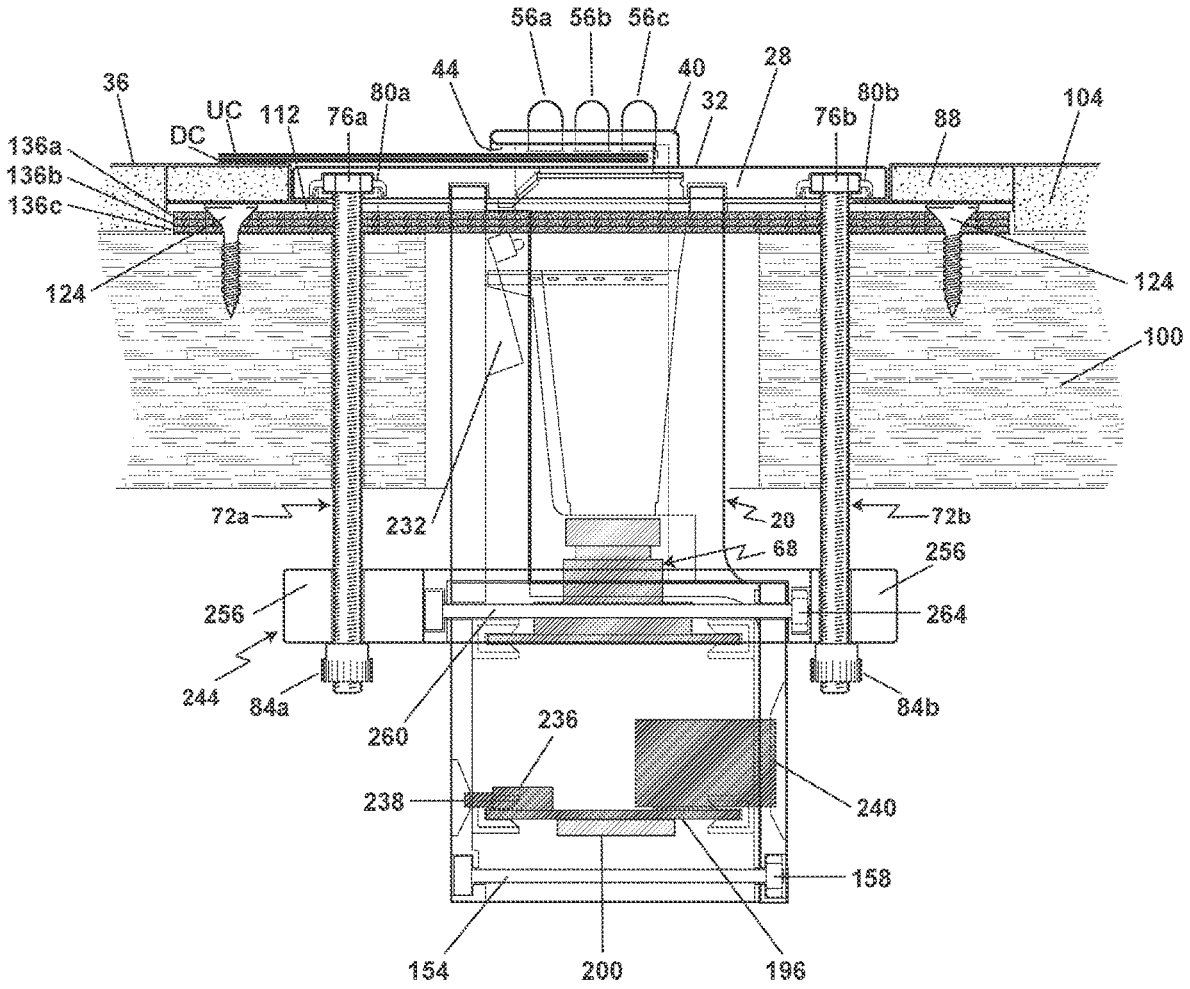
FIG. 4 is a sectional view illustrating the apparatus joined to a casino table using three reader shims.

The housing assembly 20 can possibly include, as also illustrated in FIG. 1, one or more reader shims 136 that can be located above the wood structure 100 of the casino table and below the mount plate 112. Such location is conveyed in FIG. 4, with the apparatus 10 being joined to the casino table wood structure 100. Three such shims 136*a*, 136*b*, 136*c* are shown and each can have a different thickness, but each being at least substantially the same in length, width and shape to the mount plate 112. When the apparatus 10 is installed or joined to a casino table, no reader shims 136 or one or more reader shims 136 could be utilized. Such one or more shims 136, when needed, are utilized to raise, move or otherwise position the apparatus 10 so that the upper surface 32 of the card receiver body 28 is in a desired position relative to the game layout 36. That is, during installation, a determination may be made that the upper surface 32 will be undesirably below the foam layer 104 (and the game layout 36 that is to be positioned over the foam layer 104). Such location may be due to a foam layer 104 that has a relatively larger thickness, which can cause the upper surface 32 (when one or more reader shims 136 are not used) to not be sufficiently even, or not be in substantial alignment, with the game layout 36 but below it, thereby necessitating that the apparatus 10 be raised until such alignment exists. Such raising/positioning can be accomplished using one or more reader shims 136, with the number thereof and the amount of thickness of each depending on the distance that the apparatus 10 should be raised to be in a proper position relative to the game layout 36.

Figure 5:
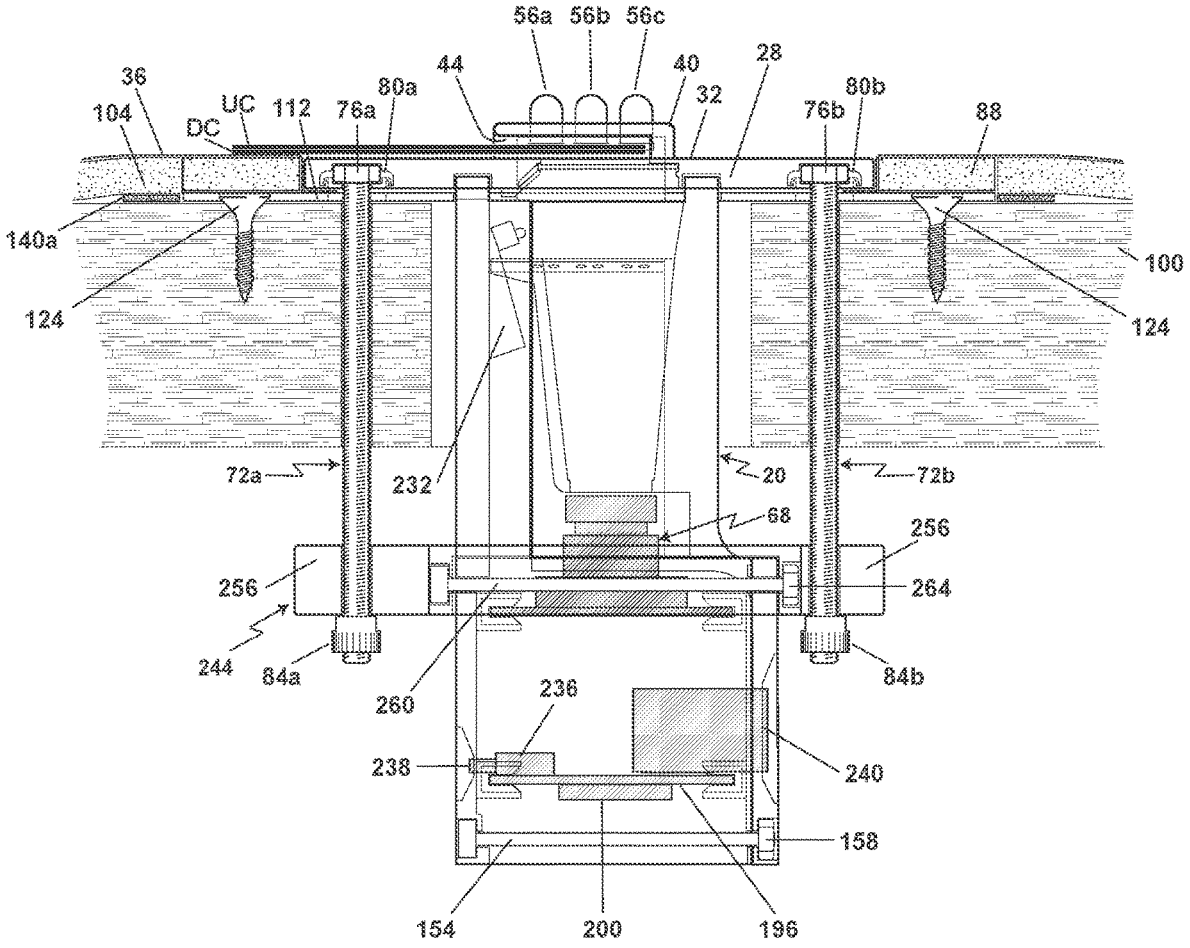
FIG. 5 is a sectional view illustrating the apparatus joined to a casino table using a single foam shim.

The housing assembly 20 can also possibly include, as further illustrated in FIG. 1, one or more foam shims 140 that can be located above the casino table wood structure 100 and below the foam layer 104. Such foam shims 140 can be horizontally adjacent to the mount plate 112, as illustrated in FIG. 5 with one foam shim 140 (e.g. 140*a*) being utilized when the apparatus 10 is joined to a casino table. Similar to possible reader shims 136, three such shims 140*a*, 140*b*, 140*c* are shown in FIG. 1 and each can have a different thickness. When the apparatus 10 is installed or joined to a casino table, no foam shims 140 or one or more foam shims 140 could be utilized. Such one or more shims 140, when needed, are utilized to raise or add thickness to the foam layer 104 so that the upper surface 32 of the card receiver subassembly 28 is in a desired position relative to the game layout 36 and correspondingly the foam layer 104. That is, during installation, a determination may be made that the upper surface 32 will be undesirably above the foam layer 104 (and the game layout 36 that is to be positioned over the foam layer 104). Such location may be due to a foam layer 104 that has a relatively smaller thickness, which can cause the upper surface 32 (when one or more foam shims 140 are not used) to not be sufficiently even, or in substantial alignment, with the game layout 36 (after being positioned over the foam layer 104) but improperly located above it, thereby necessitating that the foam layer 104 be raised or increased until such desired positioning exists. Such raising/positioning can be accomplished using one or more foam shims 140, with the number thereof and the amount of thickness of each depending on the distance that the foam layer 104 should be raised/increased so that the apparatus 10 can be in a proper position relative to the game layout 36.

From such descriptions regarding possible use of one or more reader shims 136 or one or more foam shims 140, it should be understood that, if a reader shim 136 is used, a foam shim 140 would be unnecessary and not be used. Similarly, if a foam shim 140 is used, a reader shim 136 would not be necessary and would not be used.

Figure 2:
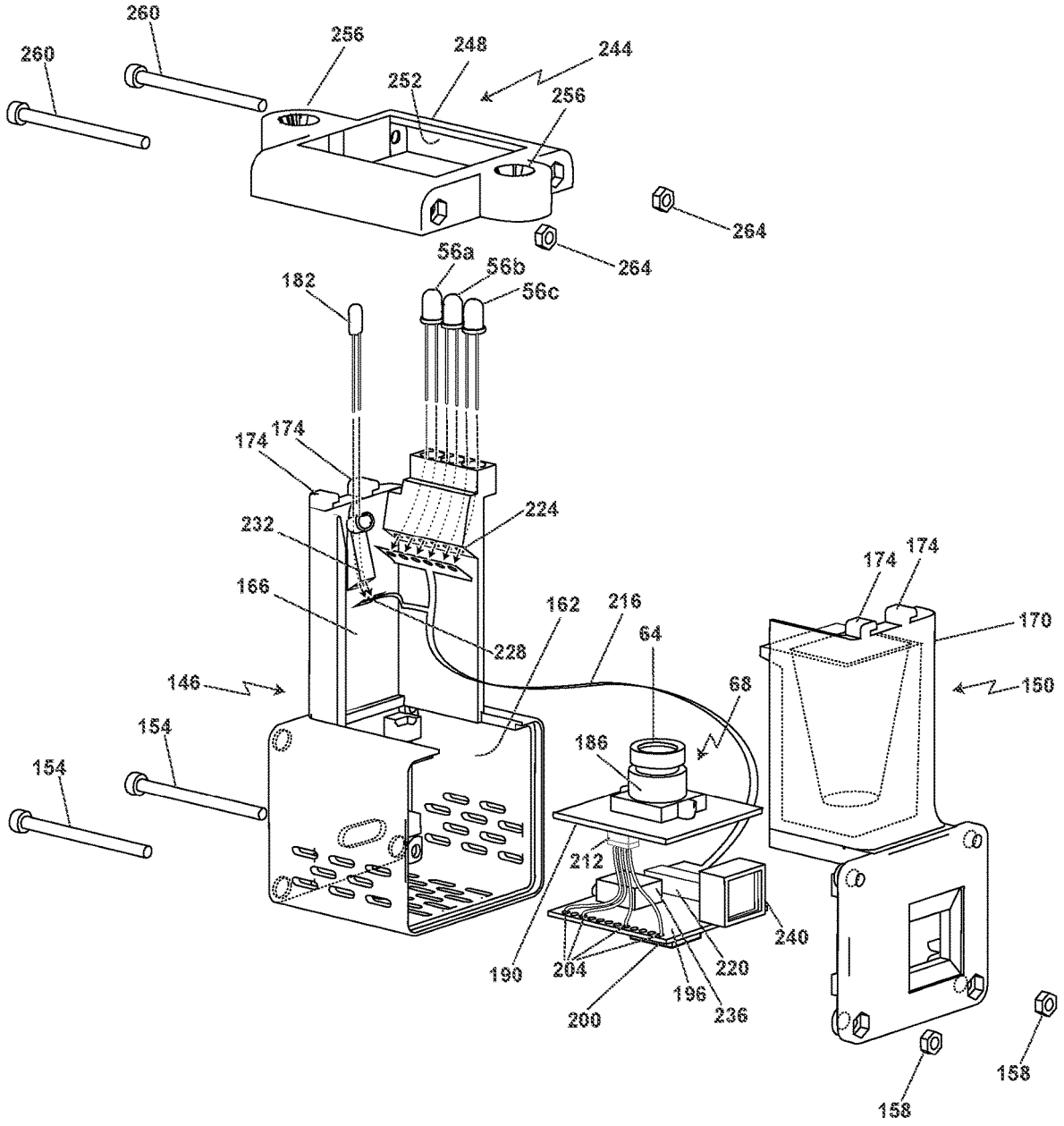
FIG. 2 is a further exploded view mainly illustrating first and second housing sections of the housing assembly, together with diagrammatical depictions of the camera assembly and the computer.

With reference primarily to FIG. 2, the housing assembly 20 can further include a first (left from the player's perspective) housing section 146 and a second (right from the player's perspective) housing section 150. Substantial portions of these two housing sections 146, 150 are located below the casino table, as depicted in FIG. 3. These two housing sections 146, 150 can be joined together, near bottom portions thereof, using bolts 154 and associated nuts 158, with a compartment or space 162 being formed within these two sections 146, 150. Such space 162 can be utilized to hold or support the camera assembly 68. Each of the first and second housing sections 146, 150 includes a wall 166, 170, respectively, and in which hooks 174 are formed at the tops of such walls 166, 170. The hooks 174 are connectable to the mount plate 112 using notches 178 (FIG. 1) formed therein, adjacent to the mount plate opening 116, whereby joined housing sections 146, 150 can be connected to the mount plate 112.

An illuminator device 182 is positioned within the space 162, preferably fixed in position near the top of the wall 166 and above the lens 64 of the camera assembly 68. The illuminator device 182 is powered to output light of a desired intensity to ensure proper operation of the camera assembly 68 by providing adequate lighting. The camera assembly 68 also includes a camera body 186 and a camera board 190 with electronic hardware or components useful in outputting the image data that is obtained by the camera assembly 68. The image data can include such data associated with the symbol or card rank provided on a particular down card currently being read. The camera assembly, in one embodiment, can be Model ELP-USB130W01MT-B/W-L21 available from Ailipu Technology Co., Ltd.

The apparatus 10 also includes a computer board 196 that includes a computer 200. As shown by FIG. 2, the computer board 196 can be located in the space 162 at the bottom of the housing assembly 20. Image or video information in the form of pixel-based data or information is carried by image data wires 204 from an electrical connector 212 of the camera board 190 to the computer board 196. Such pixel-based information can be ultimately input to the computer 200, which is supported by the computer board 196, in a digital signal format acceptable to it for processing that information by one or more processors of the computer 200. In that regard, the computer 200 executes software for processing the obtained image information, which will be described in more detail in connection with the method of invention operation and/or invention use. In one embodiment the computer board 196 can be a commercially available unit identified as NanoPi NEO that also includes memory for storing such software. The output(s) from such processing is(are) controllably used in activating one of the color indicators 56 so that the activated color indicator 56 is viewable by each player and the dealer who are playing the Down Under Blackjack™ game. Such output or outputs are carried by a lighting wire cable 216 from an electrical connector 220 of the computer board 196 to indicator connectors 224 in electrical communication with the indicators 56. This lighting wire cable 216 can include one or more illuminator wires 228 used in powering the illuminator device 182. Such illuminator wires 228 terminate at an illuminator connector 232 that can be useful in holding or supporting the illuminator device 182. Electrical power is supplied to the camera assembly 68 and computer board 196, as well as used in controlling electrical power or other activation of the indicators 56 and the illuminator device 182, by means of power unit 236 that can be provided as part of the computer board 196. The power unit 236 is connectable to an external power source using a power cable received by a power portal 238 (FIG. 3). The computer board 196 can also include an Ethernet port/connector 240.

With further reference to FIG. 2, the apparatus 10 can further include a bracket subassembly 244 that contributes to joining the housing assembly 20 to a casino table. The bracket subassembly 244 includes: a ring member 248 defining an opening 252 and having ears 256 on its perimeter, ring connectors 260 and their associated holding nuts 264. As seen in FIG. 1, the ring member 248 is disposed outwardly of and in contacting engagement with exterior portions of the housing assembly first and second sections 146, 150. The size of the ring member opening 252 is adequate to receive the joined first and second housing sections 146, 150. In that regard, the ring connectors 260 have sufficient length to interconnect the ring member 248, the first housing section 146, and the second housing section 150, near mid-portions of these two sections 146, 150, and with the holding nuts 264 completing the connection at exterior portions of the second housing section 150.

Referring also to FIG. 3, the use of the elongated fasteners 72*a*, 72*b*, together with their respective fastening nuts 84*a*, 84*b*, in joining the apparatus 10 to, or removing it from, a casino table is next described. As noted previously, the fastener heads 76*a*, 76*b* are fixedly held at the card receiver body 28, just above the mount plate 112. The lengths or bodies of the fasteners 72*a*, 72*b* extend through the casino table wood structure 100 and portions exit the same. End portions of these fasteners 72*a*, 72*b* are positioned through and held in the ring member ears 256 using the fastening nuts 84*a*, 84*b*. Preferably, such connection between the fasteners 72*a*, 72*b* and their respective and associated nuts 84*a*, 84*b* facilitates disconnection by permitting finger force tightening (without use of any tool) of such nuts 84*a*, 84*b*, thereby allowing for fastening/unfastening of such nuts 84*a*, 84*b*, utilizing the fingers of an installer/de-installer of the apparatus 10, to/from a casino table.

This advantageous configuration for supporting or holding in place key or substantial portions of the apparatus 10, as well as possible removal thereof from a casino table, is further enhanced by use of the hooks 174 formed in the walls 166, 170 of the housing sections 146, 150 and the notches 178 formed in the mount plate 112. After the mount plate 112 is attached to the wood structure 100, and with the elongated fasteners 72*a*, 72*b* extending therefrom, the first and second housing sections 146, 150, which are joined together using the bracket subassembly 244, can be moved upwardly from below the casino table wood structure 100. During such movement, the fasteners 72*a*, 72*b* are inserted in the ears 256 of the ring member 248. Such movement or placement continues with the hooks 174 ultimately being in a position to be received by the notches 178. Movement completion and desired positioning are achieved by the mating engagement between such hooks 174 and notches 178. With such engagement in place, the finger-tightened nuts 84*a*, 84*b* can be joined to their respective fasteners 72*a*, 72*b* beneath the ears 256 to secure the already joined first and second housing sections 146, 150, together with the parts or components held therein, to the casino table.

As illustrated in FIG. 3, when the apparatus 10 is connected to a casino table, substantial portions of the housing assembly 20 are located below the game layout 36. These substantial portions include portions that contain the camera assembly 68, the computer board 196 and the illuminator connector 232. FIG. 3 also shows the portions of the housing assembly 20 located above or even with the game layout 36, which portions can include the upper surface 32 of the card receiver body 28, the cover 40 and its slot 44. At least portions of the color indicators 56 positioned in the apertures 52 also extend beyond the game layout 36 for viewing by the players and dealer.

Figure 6A:
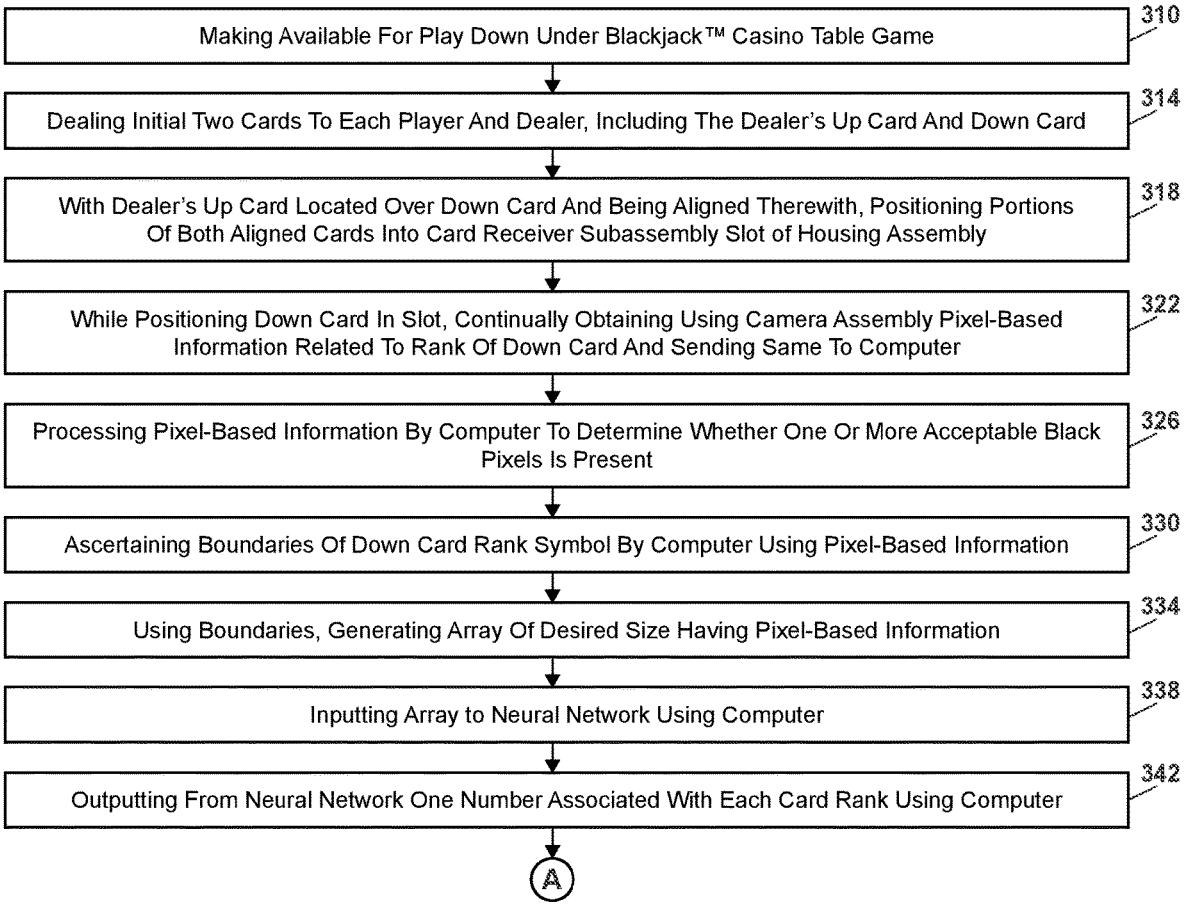
FIGS. 6A-6B are flow diagrams that provide basic steps or stages associated with one method of operation associated with the invention, particularly related to identifying and subsequently classifying the particular down card of the dealer.
Figure 6B:
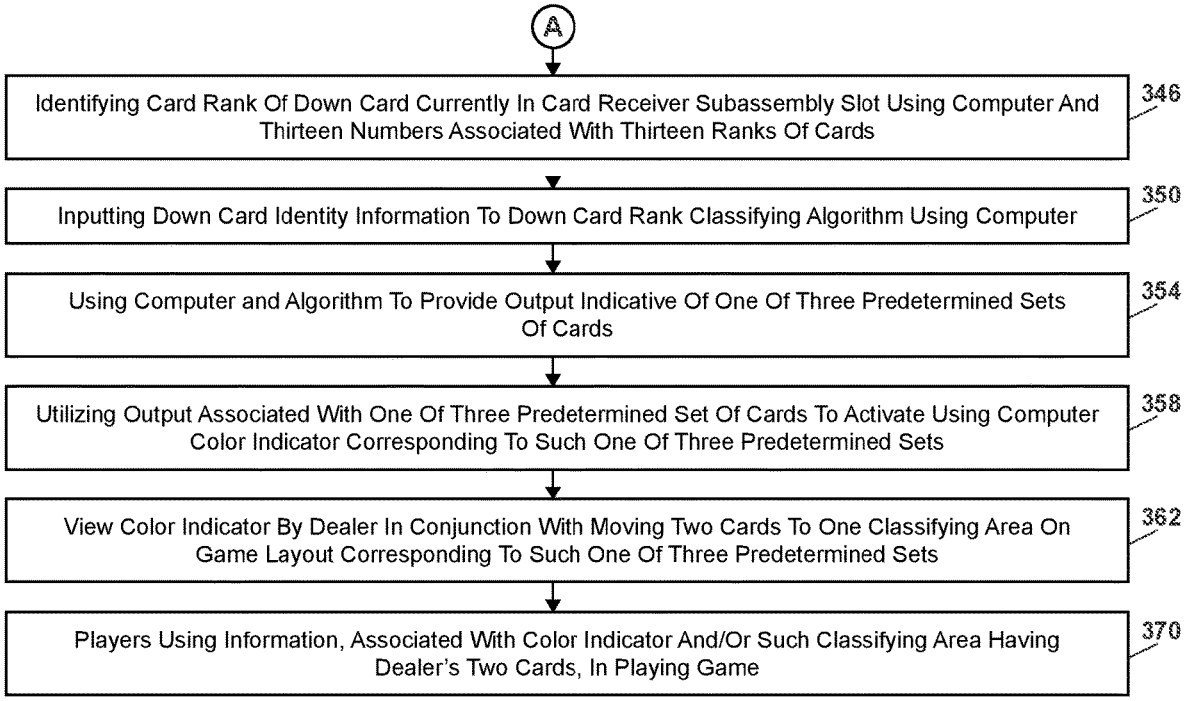

With reference to FIGS. 6A-6B, a method is described involving the apparatus 10 while playing the Down Under Blackjack™ game. This casino table game is characterized by certain rules and/or procedures that cause information related to the dealer's down card to be provided to the dealer and any player, specifically related to the rank or value of the particular down card that was dealt for the current round of game play. The game requires that all card ranks be grouped or classified in one of three predetermined sets or groups. Two through five rank or value cards are grouped in a first or small set. Six through nine rank or value cards are grouped in a second or medium set. Ten through ace rank or value cards are grouped in a third or large set. The game further requires that the dealer and each player be informed as to which of the three sets the current down card belongs before each player makes a decision related to continuing game play.

As indicated by block 310 of FIG. 6A, the method associated with the apparatus 10 involves offering the Down Under Blackjack™ game at a casino. When there are one or more players present to play a round of the game at the casino table, the method requires, as noted by block 314, dealing an initial two cards to each player, who is playing the current round of the game, and the dealer. The initial two dealer cards are an up card (exposed or up facing card) and a down card (unexposed or down facing card). According to block 318, the method includes positioning portions of both up and down cards of the dealer into the card receiver subassembly slot 44 of the housing assembly 20. Before such positioning, the up card can be disposed over the down card so that these two cards are in complete, or substantially complete, alignment. During such card positioning, including before the card is located at a final or end position, the camera assembly 68 has power applied to it and continuously obtains pictures of down card portions at a desired rate (e.g. 30 frames/second). Each such picture frame is sent to the computer 200 from the camera assembly 68, as indicated by block 322. Each picture frame is processed using the computer 200 to determine whether it has at least one desirable or acceptable pixel, as denoted by block 326. Each such one or more acceptable pixels are characterized as being properly or adequately different than blank pixels (essentially white, non-black or non-dark pixels). Typically, acceptable one or more pixels are sufficiently black pixels. Referring to block 330, after the computer 200, including its executed software, finds that a current or selected frame being processed has at least one such black pixel, further computer software is executed by the computer 200 to define or determine boundaries associated with identifying the card symbol of this down card, i.e., its value or card rank. According to one embodiment, these boundaries are obtainable using a known "flood fill" program that has been modified to facilitate implementation of the present invention. Such software is comparable to painting software that basically utilizes the at least one black pixel to determine other black pixels that are deemed to be adequately continuous with the at least one black pixel. Such continuity of black pixels is indicative of a symbol being present that can be identified. Such software outputs coordinate information associated with all such continuous black pixels. Using such coordinate information, appropriate boundaries associated with card-identifying portions (e.g. corner portions) of the down card can be defined. Basically, the coordinate information can be processed to identify the four corner boundaries of a rectangle that contains pixel-based image data (both black and white pixels) from which the down card's rank can be determined.

After the boundaries of the card-identifying portions are found, wherein it is known that the card rank or symbol can be identified using the pixel-based information within such boundaries, the computer 200 generates an array that has such pixel-based information, as indicated in block 334. The array can include substantially equal area squares obtainable using the defined rectangle. In one embodiment, the equal area squares can be twelve in a first (vertical) direction and seven in a second (lateral) direction so that there are a total of eighty-four equal squares. The computer 200 processes each of these elements of the array by finding the proportion of black pixels to white pixels in each array element. The results of the processing has each array element associated with a value in the range between zero (full white/blank) and one (full black/sufficiently dark), inclusively.

Referring next to block 338, the array including array elements can then be used by or input to a neural network executed by the computer 200, with the array elements essentially being the inputs to the neural network. In one embodiment, the neural network can be a multilayer perceptron, a commonly used neural network, which can have a hidden layer associated with a suitable or desirable number of neurons. The number of neurons can be selected based on training the neural network (e.g. sixty neurons). Such training can utilize a standard backpropagation technique or method. According to one embodiment, based on the processing done by the neural network, thirteen numbers or values can result, with each of these numbers/values being associated with one of the thirteen playing card ranks or values, as indicated by block 342. These thirteen numbers can be in the range of +1 to −1, inclusively. A match to one of the thirteen card ranks can be indicated by a number close to +1. A non-match can be indicated by a number close to −1. In another embodiment, instead of thirteen numbers, only three numbers are utilized based on the three categories/groups (small, medium and large) required to play the Down Under Blackjack™ game. In yet another embodiment, fifteen numbers are utilized to take into account differences/additions to playing cards that may be used in certain jurisdictions. That is, the letter "B" may be found on cards instead of the ten through king symbols and "no peek" indicia may be found on cards having an ace rank.

In conjunction with the outputs from the neural network and referring to block 346, the computer 200 and the thirteen numbers associated with card ranks are used to identify the actual or specific rank of the down card whose card portions are currently in the slot 44. In that regard, first computer software can be executed by the computer 200 that processes at least two of the thirteen numbers in order to achieve substantial certainty related to the identity of the down card rank. Such software can obtain the difference between a match value (close to +1) and the closest non-match value (−1). For a perfect match, the difference would be +2. In one embodiment, a difference of less than 1.99 can be rejected as having inadequate confidence of a match and so no rank would be identified. Based on such a difference, the down card can be identified. However, the Down Under Blackjack™ game requires that the down card be grouped or classified into one of three groups or sets, and not that the specific down card rank be provided to any player or dealer.

Consequently, according to block 350, information or data related to the identity of the down card rank is further processed by inputting or using such identity related information to group or classify the down card into the small, medium and large card sets previously described. To do that, an algorithm, implemented using second or classifying associated software executed by the computer 200, can be utilized. Generally, this algorithm determines the one of the three predetermined card sets associated with the currently read or used down card. Such determination can be done by matching the identified down card rank with a card rank that is a member of, or included with, one of the three predetermined sets. Matching could be accomplished by comparing the down card rank with each card rank of each predetermined set until a match is found, while tracking which predetermined set is being used during the compare. Regardless of the particular process employed, once a match is found, an output indicative of the determined one of the three sets can be output by the computer 200, as conveyed by block 354.

Next at block 358, the computer output associated with the classified down card rank (small, medium or large) is utilized to activate the corresponding color indicator 56. Such activation can be done by using this computer output to ultimately control power applied to the color indicator 56 corresponding to the classified down card rank.

Figure 7A:
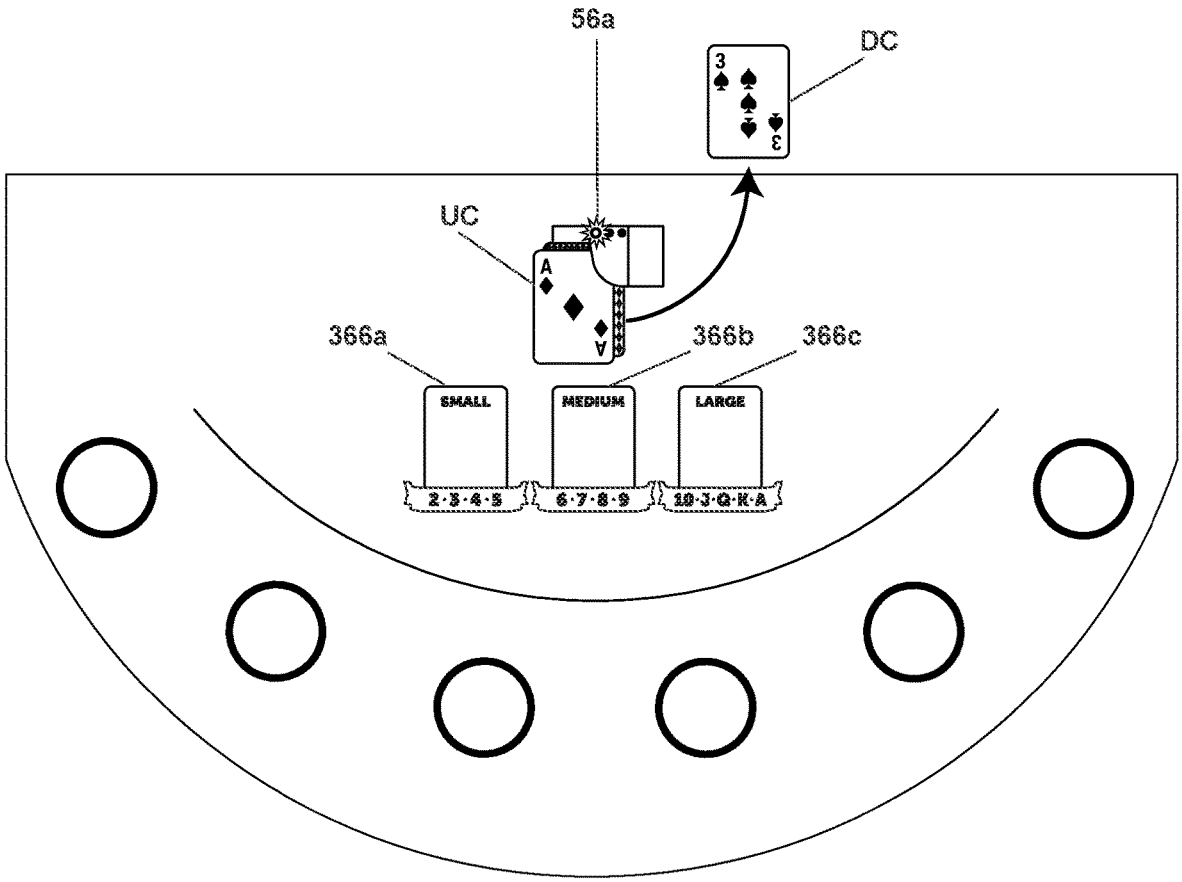
FIGS. 7A-7C are pictorial views of the card reading apparatus joined to a casino table having a layout for playing the Down Under Blackjack™ game, with each of the three views illustrating a different activated color indicator, and each of which is indicative of one of the three predetermined sets of playing cards being read.
Figure 7B:
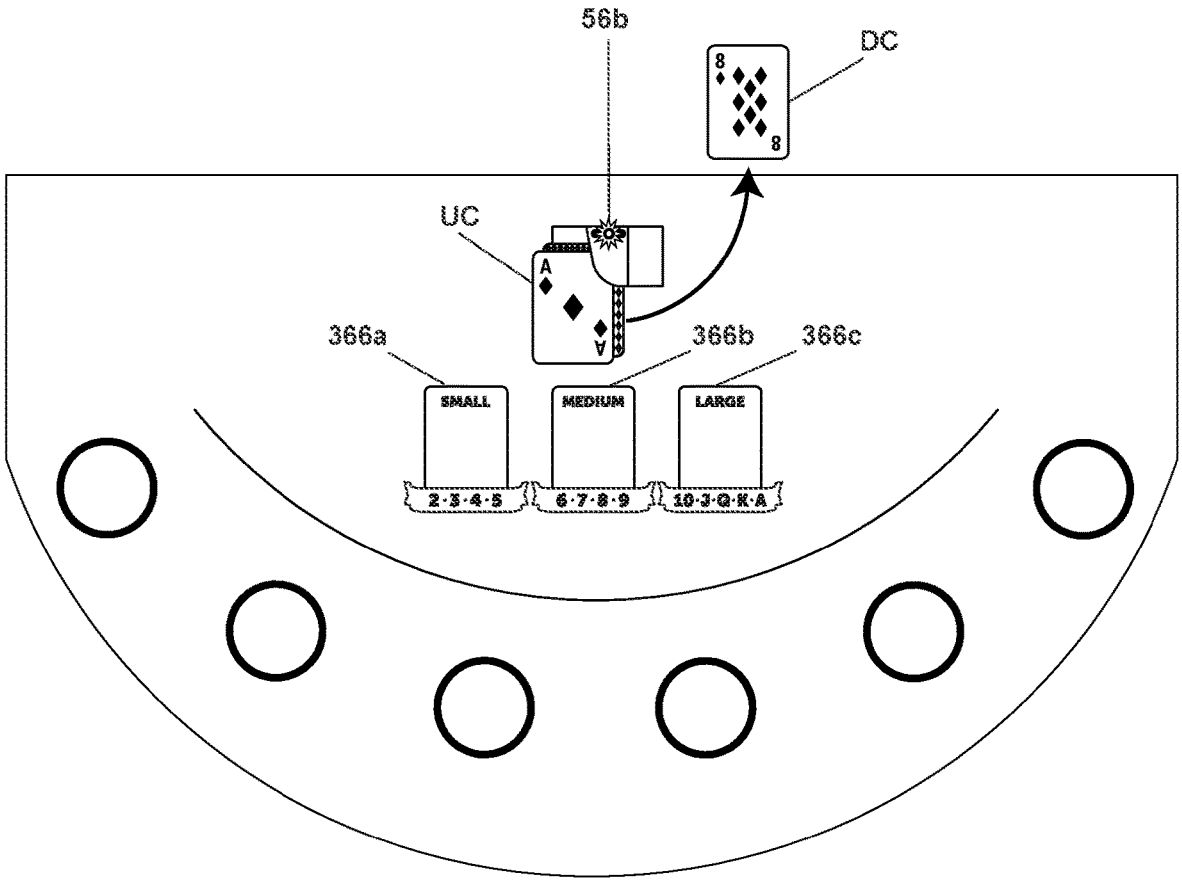
Figure 7C:
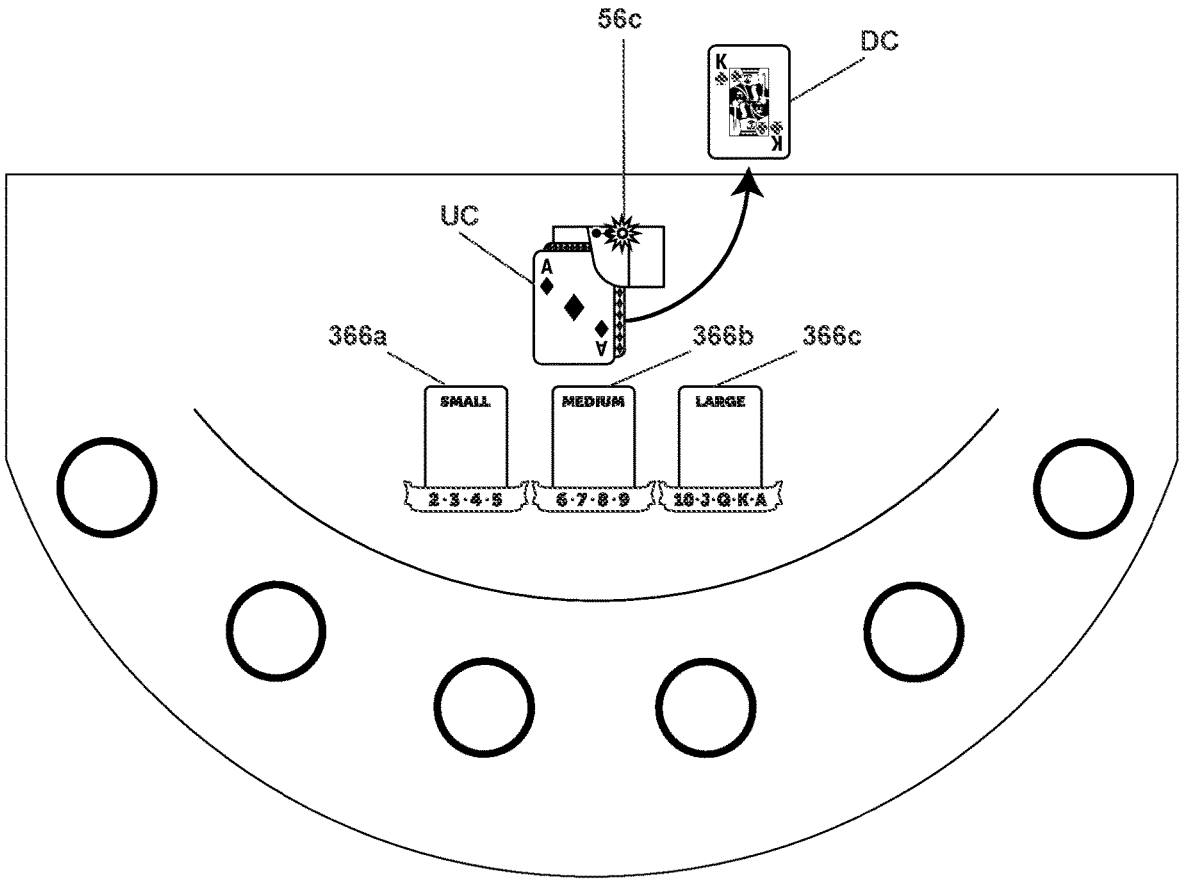

Referring to FIGS. 7A-7C, visual representations illustrate activation of different color indicators 56, depending on the correspondence between the current down card rank and the predetermined set having it as one of its members or elements. FIG. 7A illustrates activation of color indicator 56*a*, which indicator can be associated with the predetermined small set (2, 3, 4, 5 card ranks). FIG. 7B illustrates activation of color indicator 56*b*, which indicator can be associated with the predetermined medium set (6, 7, 8, 9 card ranks). FIG. 7C illustrates activation of color indicator 56*c*, which indicator can be associated with the predetermined large set (ten, jack, queen, king, ace card ranks). By way of example, when the current down card rank is identified as "8," it is classified in the medium set and the color indicator 56*b* is activated (FIG. 7B) and the players and dealer are able to see that color indicator 56*b* is turned on (lit) and color indicators 56*a*, 56*c* remain off and unlit. By way of further example with another down card and a different round of play, when that down card is identified as a king it is classified in the large set and the color indicator 56*c* is on (FIG. 7C) and color indicators 56*a*, 56*b* are off so that the dealer and players can see the differences in the states of the indicators 56.

In addition to the activation of the indicator 56 corresponding to the set of the down card rank, the dealer moves the down card with the dealer's up card on top thereof from the apparatus 10 to a corresponding classifying area on the game layout 36, as indicated by block 362. The game layout 36 includes three classifying areas 366*a*, 366*b*, 366*c*. Each one of the three areas 366 is identified to show the correspondence. One of the three classifying areas 366 can be labeled/identified as small (366*a*). Another one of these three areas can be labeled as medium (366*b*). The remaining area can be labeled as large (366*c*). Additionally or alternatively, the identifying information on the layout related to card rank sets can include the individual and specific ranks associated with each of the three classifying areas. That is, the small set can also have the ranks 2, 3, 4, 5 printed on or associated with that classifying area. Likewise, the card ranks for cards in the medium and large sets can be provided with their respective classifying areas. In continuing with the example of the current down card being identified as "8" and being classified in the medium set, after seeing the color indicator 56*b* being on or lit, the dealer recognizes that this indicator 56*b*, with a particular color different than the colors of the other two indicators 56*a*, 56*c*, is associated with the medium set and positions the down card with aligned up card in the layout classifying area 366*b* associated with the medium set.

Referring to block 370 and the remaining stage or step of FIG. 6B, each player playing the Down Under Blackjack™ game can then use the information associated with the down card rank in playing the game. In the example of the player being provided the information that the rank of the down card is associated with the medium set (down card has a rank of one of: 6, 7, 8, 9), the player can make decisions related to continuing play in order to try to beat the dealer's hand in accordance with conventional blackjack game rules.

The foregoing discussion has been presented to illustrate and describe certain embodiments of the invention. Further, the description is not intended to limit the invention to the form disclosed herein, as the inventive features might be used in other applications based on the disclosed systems and/or methods of operation and/or play. Consequently, further variations and modifications commensurate with the above teachings, within the skill and knowledge of the relevant art, are within the scope of the present invention. The embodiments described hereinabove are further intended to explain the best modes presently known of practicing the invention and to enable others skilled in the art to utilize the same as such, or in other embodiments, and with the various modifications required by their particular application or uses of the invention. It is also intended that the claims be construed to include alternative embodiments to the extent permitted by the prior art.

What is claimed is:

1. An apparatus, for use with at least one deck of conventional playing cards, each conventional deck of playing cards consisting of fifty-two cards divided into four suits of Spades, Hearts, Diamonds and Clubs, each suit consisting of thirteen playing cards consisting of number value ranks of Ace, two, three, four, five, six, seven, eight, nine, ten, and ten-value face card ranks of Jack, Queen and King, each playing card consisting of only two indicia, a first indicia identifying a single number rank or a single face rank of the playing card, and a second indicia identifying the suit of the playing card, each playing card having no other identifying indicia whatsoever, the apparatus, when playing a number of rounds of a card game, for use in identifying a conventional first playing card, that is dealt face down in each of the number of rounds, of a number of conventional playing cards including at least a conventional second playing card that is dealt face up in each of the number of rounds, comprising:

a camera assembly for use in outputting information related to the conventional first playing card that is dealt face down, a computer in communication with said camera assembly for use in receiving said information, said computer using said information to identify a first set of card value ranks of a predetermined number of sets of card value ranks that the conventional first playing card is associated with;

a plurality of indicators for use in indicating said predetermined number of sets of card value ranks using a number of outputs including a first indicator using a first output, wherein at least said first indicator for use in indicating using said first output, when playing one round of the card game, that the conventional first playing card is associated with said first set of card value ranks of said predetermined number of sets of card value ranks; and a housing assembly that holds said camera assembly, said computer and each of said plurality of indicators including said first indicator, and in which each of said plurality, of indicators is held separate from, and not part of, each of the number of conventional playing cards, including the conventional first and second playing cards;

wherein, when playing the number of rounds of the card game including when the second conventional playing card is a ten-value card or an ace, each said output of said plurality of indicators, including said first output of said first indicator, depends on the individual rank of the conventional first playing card, with the individual rank being determined using said computer, and each said output does not depend on rank of any other of the number of conventional playing cards including the conventional second playing card;

wherein, when playing the one round of the card game, only said first output of said first indicator depends on the individual rank of the conventional first playing card, with the individual rank being determined using said computer, and each of said outputs of said plurality of indicators that are different from said first indicator docs not depend on rank of any other of the number of conventional playing cards including the conventional second playing card; and wherein, when playing another round of the card game in which the rank of the conventional second playing card is different than both a ten-value card and an ace, at least one of said outputs of said plurality of indicators depends on the individual rank of the conventional first playing card, with the individual rank being determined using said computer.

2. An apparatus of claim 1, wherein said information includes pixel information that is used by software, including a neural network, executed using said computer to determine that the conventional first playing card is associated with said first set of card value ranks, and said predetermined number of sets of card value ranks includes said first set of card value ranks, a second set of card value ranks and a third set of card value ranks.

3. An apparatus of claim 2, wherein said software includes first software, which includes said neural network, used in identifying a value related to the rank of the conventional first playing card and second software stored in a memory for ascertaining that the conventional first playing card is associated with said first set of card value ranks after said first software is used in identifying said value related to the rank thereof.

4. An apparatus of claim 2, wherein said first set of card value ranks is associated with the number of conventional playing cards having a rank of two, three, four and five.

5. An apparatus of claim 1, wherein said predetermined a number of sets of card value ranks also includes a second of card value ranks set and a third set of card value ranks, and in which said plurality of indicators includes a second indicator associated with said second set of card value ranks and a third indicator associated with said third set of card value ranks.

6. An apparatus of claim 5, wherein said first output includes light and said first indicator has a first color associated therewith.

7. An apparatus of claim 1, wherein said housing assembly further includes:

a card receiver subassembly including a card receiver body;

at least a first housing section;

a bracket subassembly engaging said at least first housing section;

at least a first fastener extending between at least said card receiver body and said bracket subassembly; and at least a first fastening element joined to said first fastener adjacent to said bracket subassembly for use in connecting said bracket subassembly and said at least first housing section to said card receiver body using said at least first fastener.

8. An apparatus of claim 7, wherein said card receiver subassembly further includes a cover having a slot and said at least first housing section is used in containing said computer and said camera assembly, with said slot being used in receiving at least corner portions of the conventional first playing card, and in which at least portions of said first indicator are held using said cover.

9. An apparatus of claim 7, wherein said housing assembly further includes at least one of:

one or more reader shims that can be positioned below said card receiver body and above said bracket subassembly for use in desirably positioning said card receiver subassembly; and one or more foam shims that can be positioned below said card receiver body and above said bracket subassembly for use in desirably positioning said card receiver subassembly, said one or more foam shims having perimeter portions that are located outwardly of said card receiver subassembly.

10. A method for use in identifying a conventional first playing card that is dealt face down of at least one deck of conventional playing cards, each conventional deck of playing cards consisting of fifty-two cards divided into four suits of Spades, Hearts, Diamonds and Clubs, each suit consisting of thirteen playing cards consisting of number value ranks of Ace, two, three, four, five, six, seven, eight, nine, ten, and ten-value face card ranks of Jack, Queen and King, each playing card consisting of only two indicia, a first indicia identifying a single number rank or a single face rank of the playing card, and a second indicia identifying the suit of the playing card, each playing card having no other identifying indicia whatsoever, the method, comprising:

providing a camera assembly;

obtaining first information related to said conventional first playing card that is dealt face down using said camera assembly;

inputting said first information to a computer operatively associated with said camera assembly;

identifying, using said first information and said computer, that said conventional first playing card is associated with a first set of card value ranks of a plurality of predetermined sets of card value ranks, which art associated with said number of playing cards, said identifying includes utilizing said first information and said computer to determine rank of conventional first playing card; and providing a first indication, using a first indicator of a plurality of indicators, that said conventional first playing card is associated with said first set of card value ranks;

wherein said utilizing includes using a neural network having a number of inputs and a number of outputs including a first output and a second output, and in which said first output depends on said rank of said conventional first playing card and said first output is associated with a first determined value;

wherein said second output depends on said rank of said conventional first playing card and is associated with a second determined value, and in which said first and second determined values are used to obtain a third determined value; and wherein said rank of said conventional first playing card is determined using said third determined value and a predetermined number, with said predetermined number being equal to or different than said third determined value.

11. A method of claim 10, wherein said plurality of predetermined sets of card value ranks includes said first set of card value ranks, a second set of card value ranks and a third set of card value ranks, and with conventional playing cards of said number of conventional playing cards having a rank of Ten, Jack, Queen, King and Ace being in said third set of card value ranks.

12. A method of claim 10, wherein said camera assembly and said computer are held using a housing assembly joined to a casino table used in playing a casino game.

13. A method of claim 12, wherein said housing assembly includes a slot for use in receiving at least portions of said conventional, first playing card, with said conventional first playing card portions being vertically aligned with at least portions of said camera assembly when said conventional first playing card portions are positioned in said slot.

14. A method of claim 12, wherein said housing assembly further includes at least one of a reader shim and a foam shim, with at least one of said reader shim and said foam shim being used to position said housing assembly relative to the casino table.

15. A method of claim 12, wherein said housing assembly further includes a card receiver subassembly, a bracket subassembly and at least a first fastener, and in which said bracket subassembly is located below the casino table and said first fastener extends between said card receiver subassembly and said bracket subassembly for use in connecting at least substantial portions of said housing assembly to the casino table.

16. A method of claim 10, wherein said first indicator includes a first light-related device and said providing said first indication includes activating said first light-related device that outputs light for use in indicating that said conventional a first playing card is associated with said first set of card value ranks.

17. A method of claim 16, wherein said plurality of indicators includes a second indicator and a third indicator, with said second indicator including a second light-related device and said third indicator including a third light-related device, a housing assembly holds said first light-related device and also holds said second light-related device associated with a second set of card value ranks of said plurality of predetermined sets of card value ranks and also holds said third light-related device associated with a third set of card value ranks of said plurality of predetermined sets of card value ranks.

18. A method of claim 10, further including, after said providing said first indication, moving said conventional first playing card to a first predetermined area associated with a layout located on a casino game table, with said first predetermined area being one of a plurality of predetermined areas associated with said layout.

19. A method of claim 10, wherein a housing assembly holds each of said camera assembly, said computer and said plurality of indicators, and in which each of said plurality of indicators is held separate from, and not part of, each of the number of conventional playing cards, and wherein each said indication of said plurality of indicators, including said first indication of said first indicator, depends on individual rank of the conventional first playing card, with said individual rank being determined using said computer, and each said indication does not depend on rank of any other of the number of conventional playing cards that are different from said first conventional playing card.

* * * * *